US011273452B1

(12) United States Patent
Maranville

(10) Patent No.: US 11,273,452 B1
(45) Date of Patent: Mar. 15, 2022

(54) CLASSIFIER BOX WITH A REMOVABLE TRAP

(71) Applicant: Joseph John Maranville, Rutland, VT (US)

(72) Inventor: Joseph John Maranville, Rutland, VT (US)

( * ) Notice: Subject to any disclaimer, the term of this patent is extended or adjusted under 35 U.S.C. 154(b) by 65 days.

(21) Appl. No.: 16/576,524

(22) Filed: Sep. 19, 2019

Related U.S. Application Data

(60) Provisional application No. 62/752,262, filed on Oct. 29, 2018.

(51) Int. Cl.
*B03B 5/70* (2006.01)
*B03B 5/26* (2006.01)

(52) U.S. Cl.
CPC . *B03B 5/70* (2013.01); *B03B 5/26* (2013.01)

(58) Field of Classification Search
CPC .... B03B 5/68; B03B 5/70; B03B 5/26; B03B 5/28
See application file for complete search history.

(56) References Cited

U.S. PATENT DOCUMENTS 4,078,997 A 3/1978 Wright
4,962,858 A 10/1990 Newman et al.
5,476,177 A 12/1995 Schmidt
D377,183 S 1/1997 Emery
9,132,431 B2 9/2015 Alderson et al.
9,387,482 B2 7/2016 Goodrich et al.
9,446,415 B1 * 9/2016 Renzoni ..... B03B 5/26
9,861,989 B2 1/2018 Bell
D818,510 S 5/2018 Bell
10,081,019 B1 * 9/2018 Whitman ..... B03B 5/26
2011/0186486 A1 * 8/2011 Alderson ..... B03B 5/00 209/458

* cited by examiner

*Primary Examiner* — Michael McCullough
*Assistant Examiner* — Jessica L Burkman
(74) *Attorney, Agent, or Firm* — QuickPatents, LLC; Kevin Prince

(57) ABSTRACT

A classifier device for separating heavy materials from a stream of water and lighter materials includes an upper deck above lower deck, each deck having entrance and exit sides. The exit side of the lower deck terminates in a plurality of apertures. An exit plate is disposed adjacent the exit side of the upper deck and elevated relative thereto. A trap compartment is disposed below the exit plate and receives a removable trap that has an open top side and a plurality of pipes that each have at least one fluidizing aperture and that are aligned with one of the apertures of the lower deck. A classification plate is included between the exit side of the upper deck and the exit plate for directing the larger light materials up and over the exit plate back into the stream of water. Smaller materials drop through the classification plate into the trap.

9 Claims, 6 Drawing Sheets

CLASSIFIER BOX WITH A REMOVABLE TRAP

CROSS-REFERENCE TO RELATED APPLICATIONS

This application claims the benefit of U.S. Provisional Patent Application 62/752,262, filed on Oct. 29, 2018, and incorporated herein by reference.

STATEMENT REGARDING FEDERALLY SPONSORED RESEARCH AND DEVELOPMENT

Not Applicable.

FIELD OF THE INVENTION

This invention relates to mining, and more particularly to an improved fluid bed box classifier.

DISCUSSION OF RELATED ART

The prior art is replete with classifier boxes and other gold capturing devices that have a trap into which gold is deposited as water flows through such a device. Often the trap of such devices becomes filled with all matter of materials, some of which is valuable such as gold. It is convenient to be able to quickly empty such traps into an inspection tray, rinse out the trap, and then set-up the device again for use. However, such a process is cumbersome and results in much of the time being spent cleaning and rinsing equipment rather than collecting gold.

Accordingly, there is a need for a classifier box type invention that has a removable trap that may be quickly removed, rinsed and re-inserted into the device. Further, such a needed invention would be relatively easy to maneuver and utilize in a running stream of water, and would be particularly effective at collecting gold or other valuable, heavy ores. Such a needed device would allow the user to see into its various areas to inspect the collection process at all steps. The present invention accomplishes these objectives.

SUMMARY OF THE INVENTION

The present device is a classifier device for separating heavy solid materials, such as gold, from a stream of water and lighter materials, such as sand and rocks. The classifier device includes an upper deck disposed above a lower deck in a scoop portion configured for placement in the stream of water. Each deck has an entrance side for receiving the stream of water, and an exit side. Each deck has raised sides to channel the water therealong from the entrance side to the exit side.

The exit side of the lower deck terminates in a plurality of apertures. An exit plate is disposed adjacent the exit side of the upper deck and elevated relative thereto. Preferably the lower deck, upper deck, and exit plate are made from a transparent plastic sheet material, which may be fixed together with a rigid metal corner bracket for example. Further, in some embodiments, the exit side of the lower and upper decks are narrower than the entrance sides of the lower and upper decks, whereby water exits the lower and upper decks at a greater pressure than at the entrance to the lower and upper decks.

A trap compartment is disposed below the exit plate and is configured to receive a removable trap slidably therein. The trap has an open top side and a plurality of pipes traversing from an entrance side to an exit side thereof. Each pipe has at least one fluidizing aperture on a bottom side thereof. Further, each pipe is aligned with one of the apertures of the lower deck when the trap is retained within the trap compartment.

A classification plate is included between the exit side of the upper deck and the exit plate. The classification plate is configured for directing the larger light materials up and over the exit plate and back into the stream of water. Smaller materials are allowed to drop through the classification plate into the trap.

In use, with the classifier device in an aligned with the stream of water, a mix of materials are deposited onto the upper deck and washed by the stream of water along the upper deck to the classification plate where larger, lighter materials are washed up and over the exit plate and smaller, heavier materials drop through the classification plate into the trap. Water from the lower deck traverses under relatively high pressure through the pipes of the trap, some of which exits the fluidizing apertures to mix with the smaller heavier materials to allow the heaviest materials to sink. The rest of the materials are washed out and over the open top side of the trap to exit into the stream of water. Upon collection of a sufficient amount of heavy materials in the trap, the trap is removed and emptied into an inspection pan (not shown), rinsed out, and re-inserted into the trap compartment.

Preferably the trap further includes a sealing cushion at a front end thereof, through which the apertures of the exit side of the lower deck traverse. As such, water traveling through the apertures is directed through the pipes of the trap and not therearound. Moreover, each pipe may extend forward by a distance sufficient to traverse the cushion and the apertures of the lower deck.

The present invention is a classifier box type device that has a removable trap that may be quickly removed, rinsed and re-inserted into the device. Further, the present invention is relatively easy to maneuver, handle and utilize in a running stream of water, and is particularly effective at collecting gold and other valuable, heavy ores. The present device allows the user to see into its various areas to inspect the collection process at all steps. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
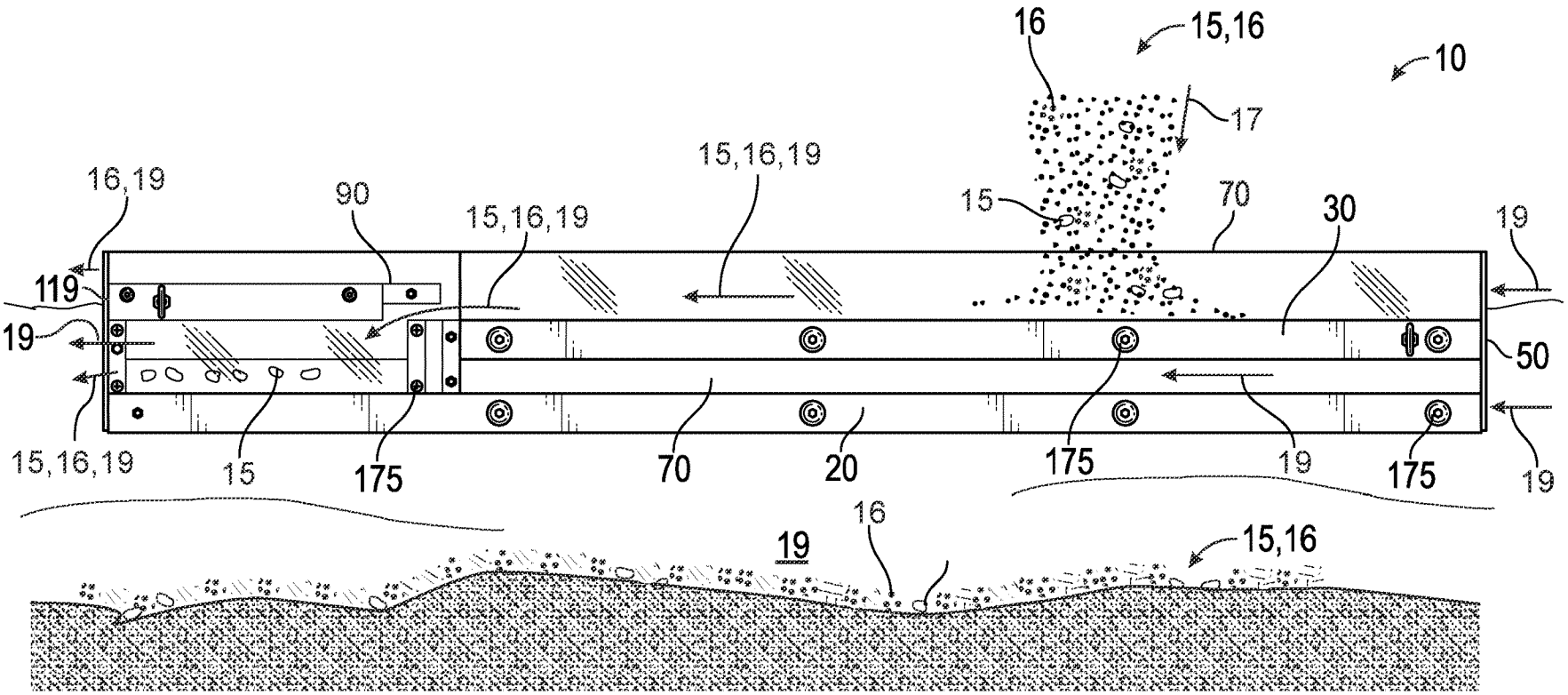
FIG. 1 is a side elevational view of the invention as used in a stream of water.
Figure 2:
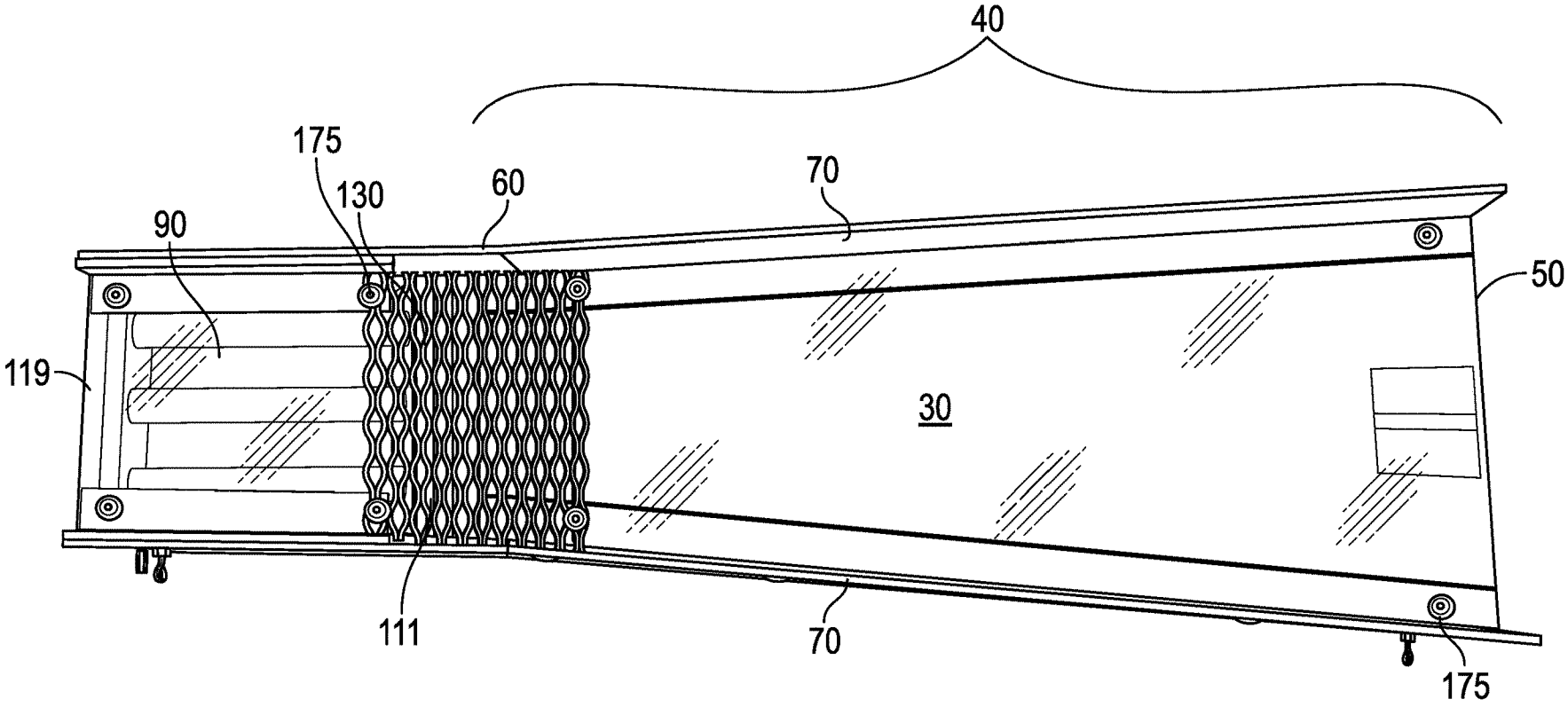
FIG. 2 is a top plan view thereof.

FIGS. 1 and 2 illustrate a classifier device 10 for separating heavy solid materials 15, such as gold, from a stream of water 19 and lighter materials 16, such as sand and rocks 16.

Figure 3:
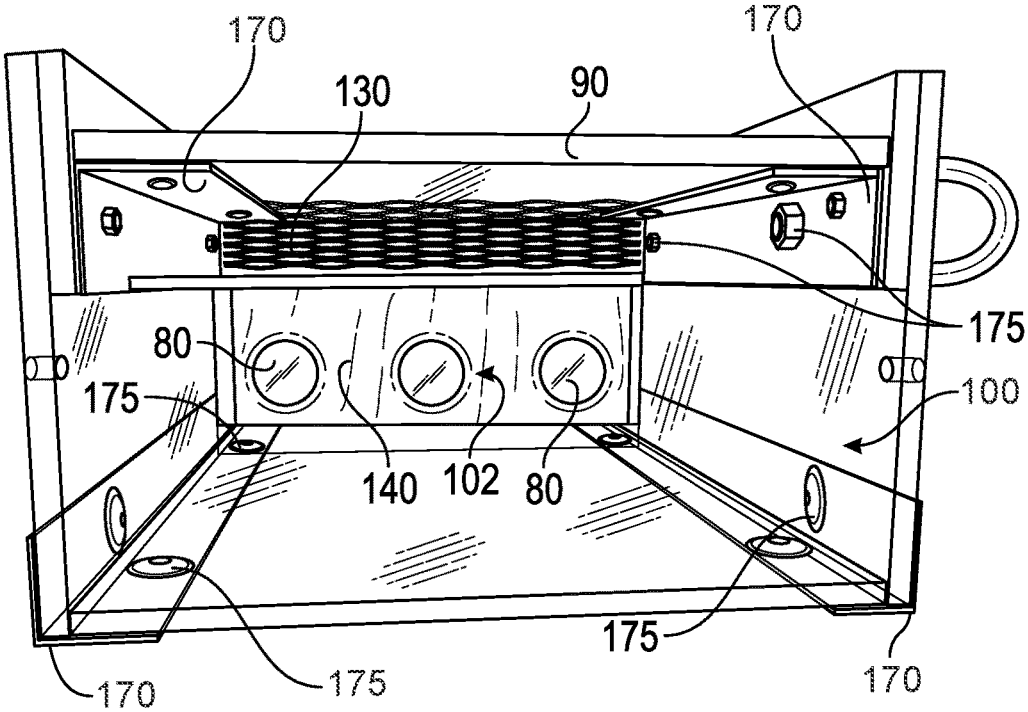
FIG. 3 is a rear elevational view thereof, illustrating a trap compartment with a removable trap omitted therefrom for clarity of illustration.

The classifier device 10 includes an upper deck 30 disposed above a lower deck 20 in a scoop portion 40 configured for placement in the stream of water 19. Each deck 20,30 has an entrance side 50 for receiving the stream of water 19, and an exit side 60. Each deck 20,30 has raised sides 70 to channel the water therealong from the entrance side 50 to the exit side 60. The exit side 60 of the lower deck 20 terminates in a plurality of apertures 80. An exit plate 90 is disposed adjacent the exit side 60 of the upper deck 30 and is elevated relative thereto. Preferably the lower deck 20, upper deck 30, and exit plate 90 are made from a transparent plastic sheet material, which may be fixed together with a rigid metal corner bracket 170 (FIG. 3) and mechanical screw fasteners 175, such as a bolt and nut arrangement, rivets, or the like, for example. Further, in some embodiments, the exit sides 60 of the lower and upper decks 20,30 are narrower than the entrance sides 50 of the lower and upper decks 20,30, whereby water exits the lower and upper decks 20,30 at a greater pressure than at the entrance side 50 to the lower and upper decks 20,30.

Figure 4:
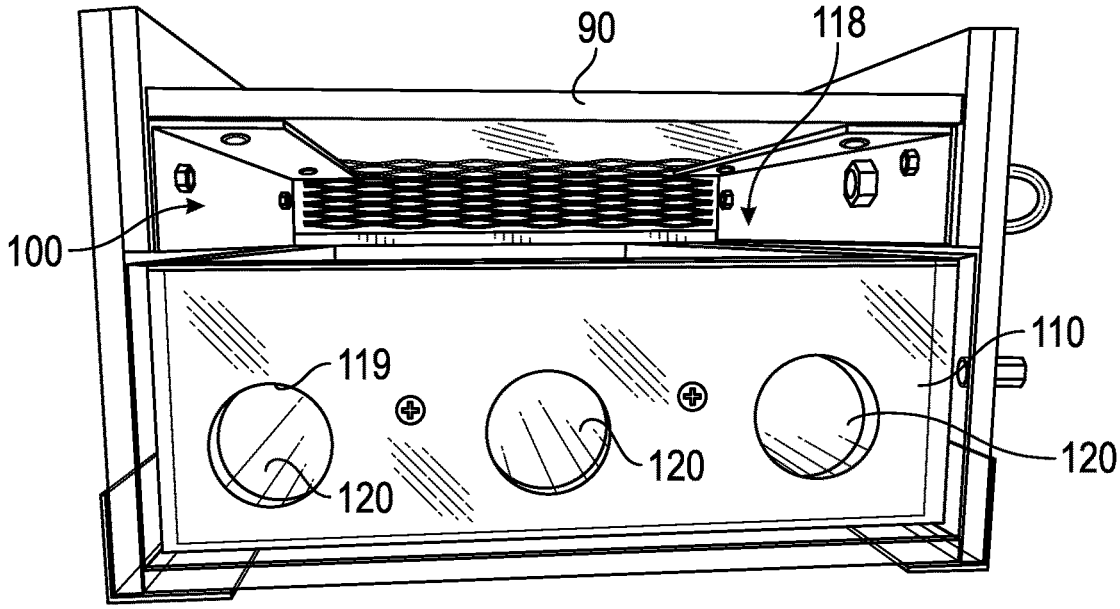
FIG. 4 is a rear elevational view of FIG. 3 with the trap included in the trap compartment.
Figure 5:
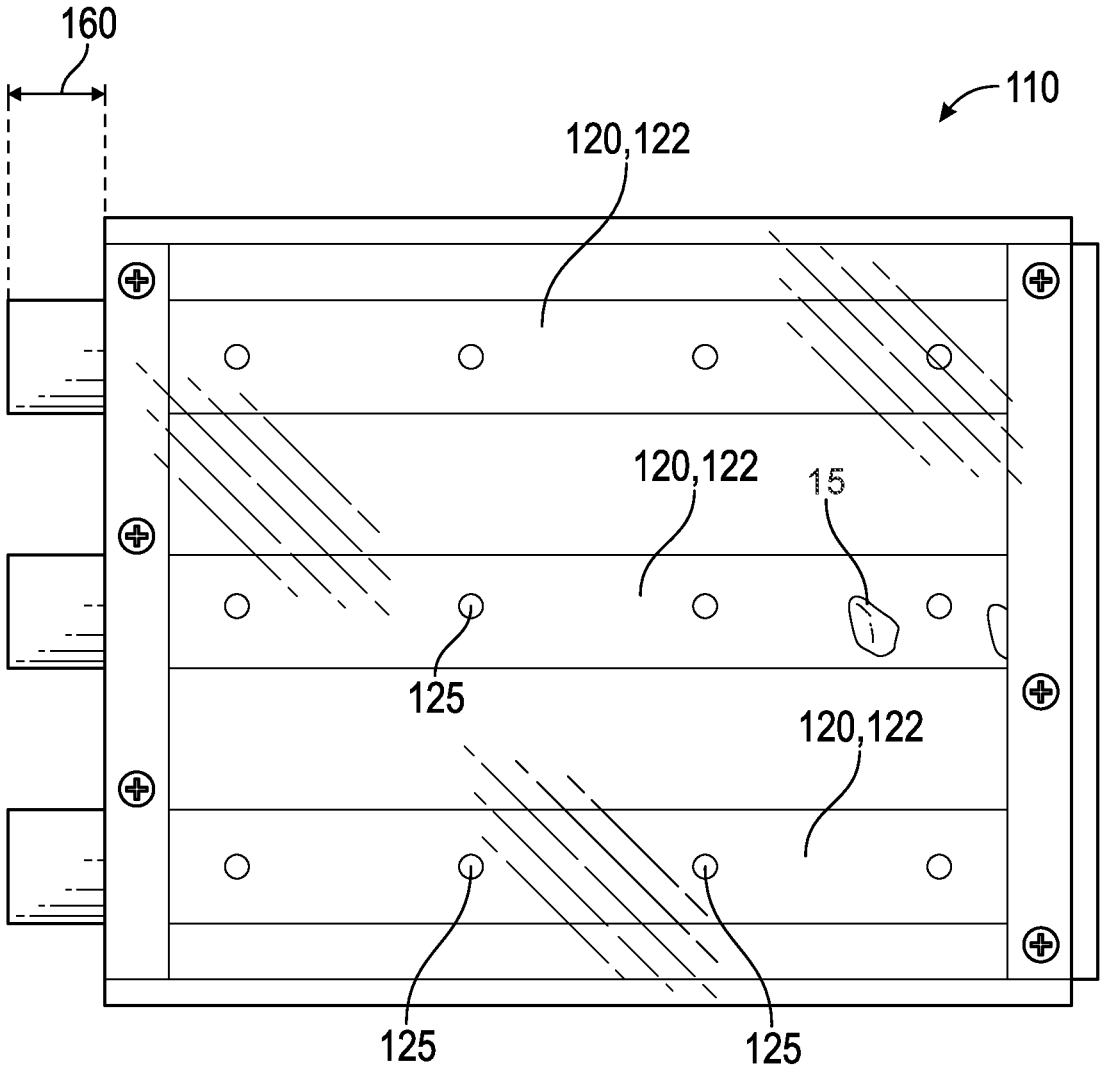
FIG. 5 is a bottom plan view of the trap.
Figure 6:
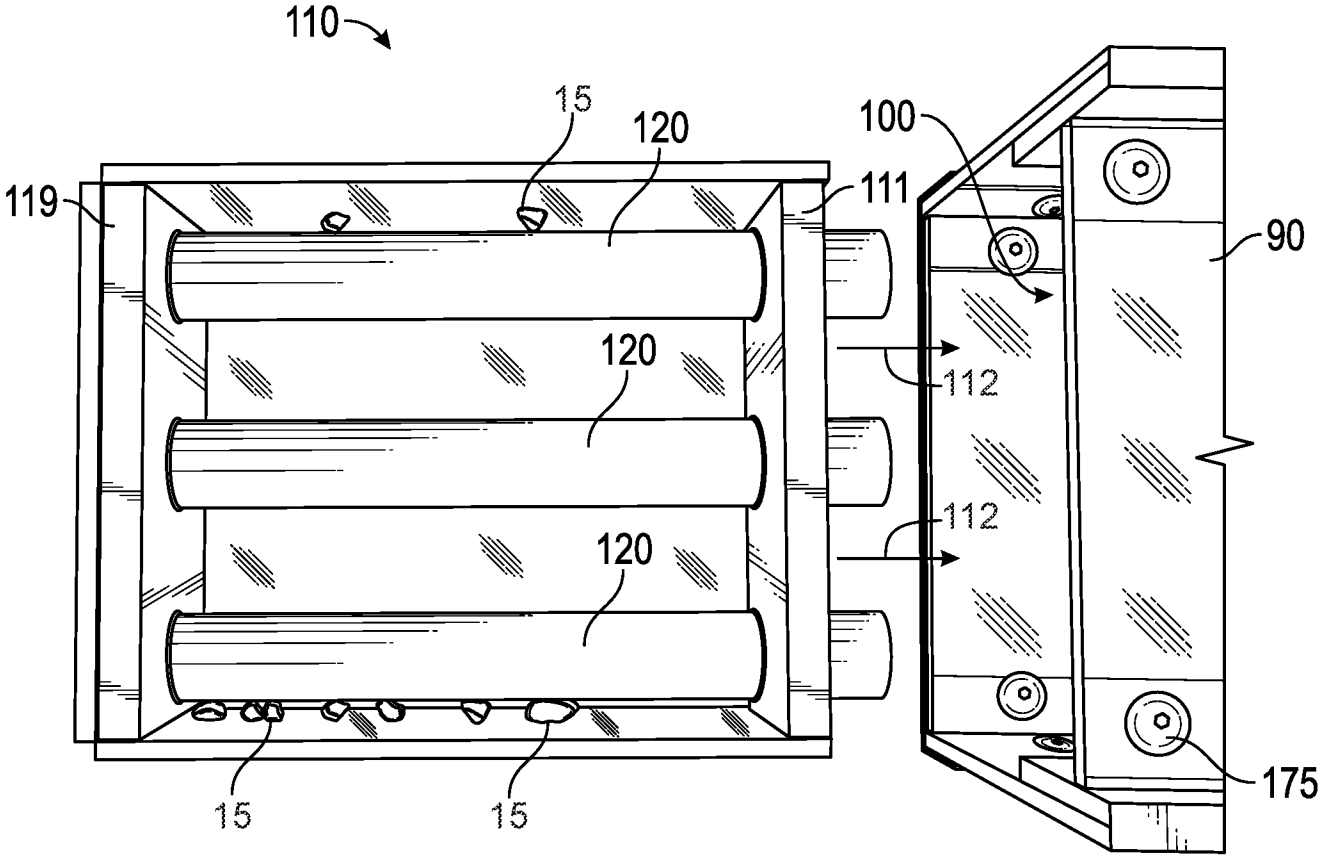
FIG. 6 is a partial top plan view showing the trap before insertion into the trap compartment.

A trap compartment 100 (FIGS. 3 and 4) is disposed below the exit plate 90 and is configured to receive a removable trap 110 slidably therein (FIGS. 5 and 6). The trap 110 may be slidably Filed: Sep. 19, 2019 inserted into the trap compartment 100 in a direction 112 (FIG. 6). The trap 110 has an open top side 118 and a plurality of pipes 120 traversing from an entrance side 111 to an exit side 119 thereof. Each pipe 120 has at least one fluidizing aperture 125 on a bottom side 122 thereof. Further, each pipe 120 is aligned with one of the apertures 80 of the lower deck 20 when the trap 110 is retained within the trap compartment 100.

A classification plate 130 (FIG. 2) is included between the exit side 60 of the upper deck 30 and the exit plate 90. The classification plate 130 is configured for directing larger lighter materials 16 up and over the exit plate 90 and back into the stream of water 19. Smaller heavy materials 15 and smaller lighter materials 16 are allowed to drop through the classification plate 130 and into the trap 110.

In use, with the classifier device 10 in and aligned with the stream of water 19, a mix of heavy and lighter materials 15,16 are deposited, such as in a downward direction 17, onto the upper deck 30 and washed by the stream of water 19 along the upper deck 30 to the classification plate 130 where larger lighter materials 16 are washed up and over the exit plate 90 and smaller heavy materials 15 and smaller lighter materials 16 drop through the classification plate 130 and into the trap 110. Water from the lower deck 20 traverses under relatively high pressure through the pipes 120 of the trap 110, some of which exits the fluidizing apertures 125 to mix with the smaller heavy materials 15 to allow the heaviest materials 15 of the heavy materials 15 to sink. The rest of the smaller heavy materials 15 and smaller lighter materials 16 are washed out and over the open top side 118 of the trap 110 to exit into the stream of water 19. Upon collection of a sufficient amount of heavy materials 15 in the trap 110, the trap 110 is removed and emptied into an inspection pan (not shown), rinsed out, and re-inserted into the trap compartment 100. A second trap 110 may be used in the classifier device 10 while the first trap 110 is being emptied and rinsed, allowing for even greater collection efficiency.

Preferably the trap compartment 100 further includes a sealing cushion 140 (FIG. 3) at a front end 102 thereof, through which the apertures 80 of the exit side 60 of the lower deck 20 traverse. As such, water traveling through the apertures 80 is directed through the pipes 120 of the trap 110 and not therearound. Moreover, each pipe 120 may extend forward by a distance 160 sufficient to traverse the sealing cushion 140 and the apertures 80 of the exit side 60 of the lower deck 20.

Figure 7:
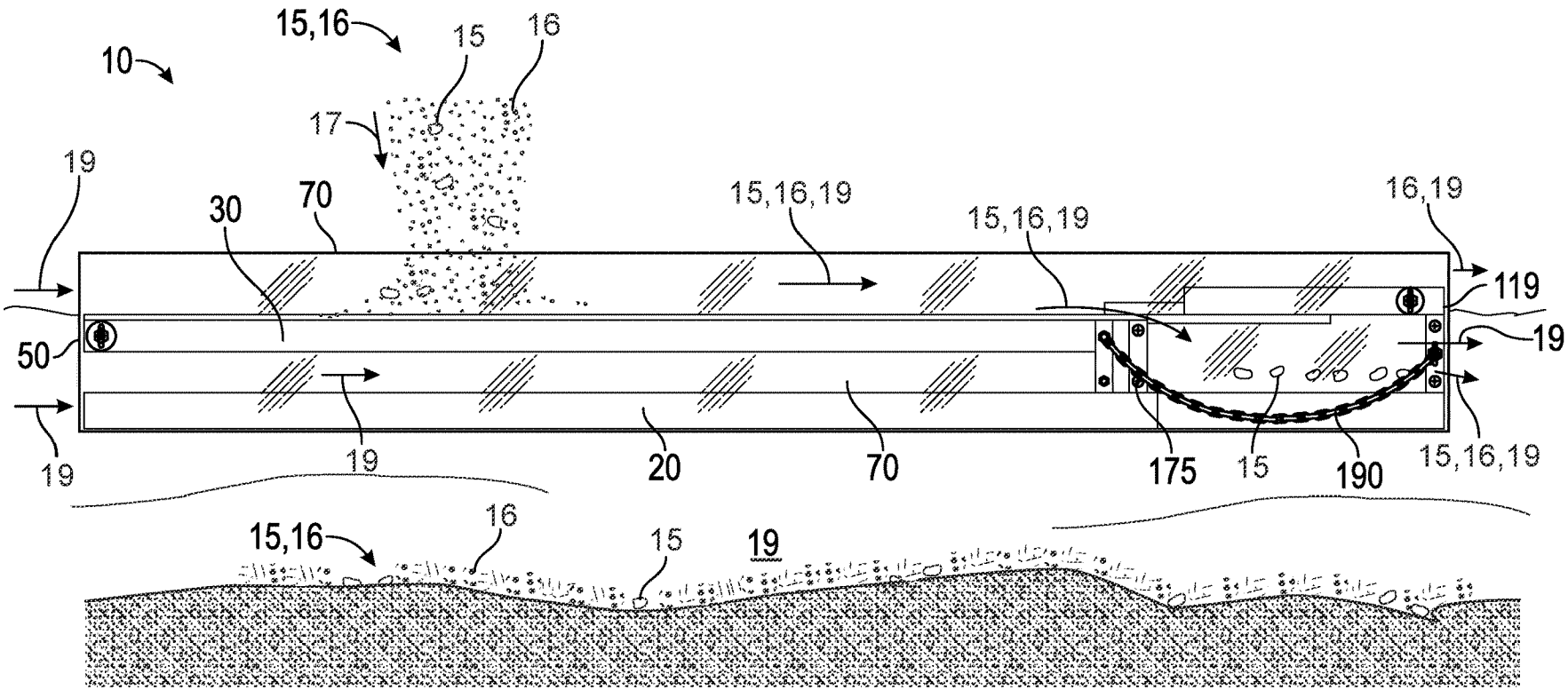
FIG. 7 is a side elevational view of an alternate embodiment of the invention.

FIG. 7 illustrates an alternate embodiment of the invention, wherein the sides 70 are fastened with the upper deck 20 with the corner bracket 170 and an adhesive (not shown). Further, chain 190 can be included to secure the mechanical fasteners 175 to the classifier device 10 to inhibit misplacing the mechanical fasteners 175 when disassembling the classifier device 10 for cleaning, transporting, storing, or the like.

While a particular form of the invention has been illustrated and described, it will be apparent that various modifications can be made without departing from the spirit and scope of the invention. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A classifier device for separating heavy materials from a stream of water and lighter materials, the classifier device comprising:

an upper deck disposed above a lower deck, each deck configured for placement in the stream of water, each deck having an entrance side for receiving the stream of water and an exit side opposing the entrance side, each deck further having raised sides to channel the water therealong from the entrance side to the exit side, the exit side of the lower deck terminating in a plurality of apertures, each of the apertures of the exit side of the lower deck facing at least the entrance side of the lower deck, the upper deck being further configured for receiving the heavy materials and the lighter materials thereon such that the heavy materials and the lighter materials are capable of being washed by the stream of water along the upper deck to the exit side thereof;

an exit plate disposed adjacent the exit side of the upper deck and elevated relative thereto;

a trap compartment disposed below the exit plate and configured to receive and retain a removable trap slidably therein, the trap having an open top side and a plurality of pipes traversing from an entrance side of the trap to an exit side of the trap, each pipe having at least one fluidizing aperture on a bottom side thereof, each pipe further having an inlet opening facing and being aligned with one of the apertures of the exit side of the lower deck when the trap is retained within the trap compartment, each pipe configured for allowing the water from the exit side of the lower deck to traverse through the pipe under pressure when the trap is retained within the trap compartment, with some of the water exiting the at least one fluidizing aperture;

a classification plate inclined between the exit side of the upper deck and the exit plate, the classification plate configured for directing larger lighter materials of the lighter materials up and over the exit plate and back into the stream of water, and for allowing smaller lighter materials of the lighter materials and smaller heavy materials of the heavy materials to drop through into the trap compartment and into the trap when the trap is retained within the trap compartment, with at least some of the smaller lighter materials and at least some of the smaller heavy materials in the trap being allowed to wash out and over the open top side of the trap to exit back into the stream of water.

2. The classifier device of claim 1 wherein the trap compartment includes a sealing cushion at a front end thereof through which the apertures of the exit side of the lower deck traverse, whereby water traveling through the apertures is directed through the pipes of the trap and not therearound.

3. The classifier device of claim 1 wherein the upper and lower decks, exit plate, and trap compartment are made with a plurality of transparent plastic sheets, whereby a user can see through the plastic sheets to observe when the trap is full.

4. The classifier device of claim 2 wherein each pipe of the trap extends forwardly beyond the entrance side of the trap by a distance sufficient to traverse the sealing cushion when the trap is retained within the trap compartment.

5. The classifier device of claim 2 wherein each pipe of the trap extends forwardly beyond the entrance side of the trap by a distance sufficient to traverse the sealing cushion and the apertures of the exit side of the lower deck when the trap is retained within the trap compartment.

6. The classifier device of claim 1 wherein the exit side of the upper and lower decks are narrower than the entrance sides of the upper and lower decks, whereby the water exits the upper and lower decks at a greater pressure than when entering the upper and lower decks.

7. The classifier device of claim 1 wherein the raised sides are attached with the upper deck and lower deck with a rigid corner bracket and adhesive.

8. The classifier device of claim 1 wherein the raised sides are attached with the upper deck and lower deck with a rigid corner bracket and mechanical fasteners.

9. The classifier device of claim 1 wherein the exit plate is maintained in a fixed orientation relative to at least the upper deck.

* * * * *